US005336881A

United States Patent [19]

Caserta et al.

[11] Patent Number: 5,336,881

[45] Date of Patent: Aug. 9, 1994

[54] HIGH LIGHT RESOLUTION CONTROL OF AN IMAGE INTENSIFIER TUBE

[75] Inventors: Joseph N. Caserta; Nathan R. Schlotthober, both of Roanoke, Va.

[73] Assignee: ITT Corporation, New York, N.Y.

[21] Appl. No.: 24,410

[22] Filed: Mar. 1, 1993

[51] Int. Cl.[5] ..... H01V 40/14

[52] U.S. Cl. ..... 250/214 VT; 313/537

[58] Field of Search ..... 250/214 VT, 207; 315/307; 313/537, 529, 527, 528, 530

[56] References Cited

U.S. PATENT DOCUMENTS

| | | | |
|---|---|---|---|
| 4,134,009 | 1/1979 | Dippold | 250/214 VT |
| 4,926,039 | 5/1990 | Garfield et al. | 250/214 VT |
| 5,146,077 | 9/1992 | Caserta et al. | 313/537 |

*Primary Examiner*—David C. Nelms

*Attorney, Agent, or Firm*—Arthur L. Plevy; Patrick M. Hogan

[57] ABSTRACT

The photocathode of an image intensifier is pulsed ON and OFF at a rate determined by a thyristor or SCR having the anode to cathode path coupled to the photocathode and the gate electrode triggered by a variable resistor, capacitor (RC) circuit to cause the photocathode to draw or conduct current only during the OFF interval of the SCR. During the ON interval of the SCR, the photocathode is OFF or non-conducting, wherein the controlled image intensifier tube exhibits a relatively constant resolution over a wide range of input light input values as from $10^{-6}$ to $10^{1}$ foot-candles.

20 Claims, 3 Drawing Sheets

HIGH LIGHT RESOLUTION CONTROL OF AN IMAGE INTENSIFIER TUBE

FIELD OF THE INVENTION

This invention relates in general to apparatus for high light resolution control of image intensifier tubes and in particular to a resolution control circuit that operates to control the photocathode "ON" time of an image intensifier tube.

BACKGROUND OF THE INVENTION

U.S. Pat. No. 5,146,077 entitled "GATED VOLTAGE APPARATUS FOR HIGH LIGHT RESOLUTION AND BRIGHT SOURCE PROTECTION OF AN IMAGE INTENSIFIER TUBE," issued on Sep. 8, 1992 to Joseph N. Caserta, et al., and is assigned to ITT Corporation, the assignee herein. The '077 patent is particularly pertinent to the invention herein. That patent describes the problems of the prior art image intensifier devices in regard to bright source protection and high light resolution. Pertinent portions of the background of the invention as present in the '077 patent are repeated herein for the sake of clarity and completeness.

Image intensifiers are well known for their ability to enhance night-time vision. The image intensifier multiplies the amount of incident light received by it to produce a signal that is bright enough for presentation to the eyes of a viewer. These devices, which are particularly useful for providing images from dark regions, have both industrial and military application. The U.S. military uses image intensifiers during night-time operations for viewing and aiming at targets that otherwise would not be visible. Night radiation is reflected from the target, and the reflected energy is amplified by the image intensifier. As a result, the target is made visible without the use of additional light. Other examples include using image intensifiers for enhancing the night vision of aviators, for providing night vision to sufferers of retinitis pigmentosa (night blindness), and for photographing astronomical bodies.

A typical image intensifier includes an objective lens, which focuses visible and infrared radiation from a distant object onto a photocathode. The photocathode, a photoemissive wafer that is extremely sensitive to low-radiation levels of light in the 580–900 nm spectral range, provides an emission of electrons in response to the electromagnetic radiation. This photoresponse is non-linearly related to the voltage at the photocathode. Electrons emitted from the photocathode are accelerated towards a phosphor screen (anode), which is maintained at a higher positive potential than the photocathode. The phosphor screen converts the electron emission into visible light. An operator views the visible light provided by the phosphor screen.

Brightness of the image is increased by placing a microchannel plate (MCP) between the photocathode and phosphor screen. A thin glass plate having an array of microscopic holes through it, the MCP increases the density of the electron emission. Each electron impinging on the MCP results in the emission of a number of secondary electrons which, in turn, causes the emission of more secondary electrons. Thus, each microscopic hole acts as a channel-type secondary emission electron multiplier having a gain of up to several thousand. The electron gain of the MCP is controlled primarily by the potential difference between its input and output planes.

Two such image intensifiers tubes, the GEN II Image Intensifier Tube and a GEN III Image Intensifier Tube, are manufactured by ITT Electro Optical Products Division, in Roanoke, Va. The GEN II Image Intensifier Tube employs an alkaline photocathode, whose potential varies roughly one volt, depending on the input light level. In the GEN III Image Intensifier Tube, the photocathode is made of Gallium Arsenide. Unlike the alkaline photocathode of the GEN II tube, the Gallium Arsenide photocathode of the GEN III tube is susceptible to being bombarded by the positive ions from the MCP. To prevent this bombardment, the MCP is coated with a film of aluminum oxide.

A bright source can degrade the resolution of an image intensifier tube. Resolution of the tube is based upon its ability to resolve line pairs. When the tube goes to high light, the MCP increases the flow of electrons. Some channels in the MCP may become saturated, in which event resolution is degraded. If the source becomes brighter, the photocathode emits a greater number of electrons (i.e. the photocathode draws additional current). As a result of the MCP gain, more channels become saturated and the resolution is further degraded. The resolution of a bright source at high light becomes unacceptable.

Bright source protection circuits are employed to improve the resolution of an image at high light. In the GEN II tube, for instance, the photoresponse of the photocathode is reduced as the source becomes brighter. The bright source protection circuit includes a dropping resistor that is connected between the photocathode and a voltage multiplier, which provides an operating potential to the photocathode. As the current drawn by the photocathode increases, the voltage drop across the dropping resistor also increases. The potential supplied to the photocathode is lowered, and the photocathode provides a lower current in response to the bright input light. Thus, the photoresponse of the photocathode is automatically reduced and although the resolution is greatly reduced, the high light range of the GEN II image intensifier tube is increased.

As indicated in the '077 patent, this type of prior art bright source protection circuit cannot be employed for the GEN III tube. Whereas the voltage to the GEN II photocathode can be dropped to 1 volt out of 250, the voltage cannot be dropped to one volt for the GEN III photocathode. This is due to the aluminum oxide film on the MCP. Electrons emitted from the cathode must have sufficient energy to penetrate the aluminum oxide film; otherwise, no tube output. The voltage required to penetrate the aluminum oxide film is defined as the tube clamp voltage. Therefore, if the photocathode voltage is lower than the tube clamp voltage, the electrons from the photocathode cannot penetrate the aluminum oxide film, and the tube goes out.

To prevent the GEN III image intensifier tube from having a dead zone, the photocathode voltage is clamped at a level above the tube clamp voltage. The dropping resistor is connected between the voltage multiplier and the photocathode. The anode of a diode is connected to the input terminal of the photocathode, and the cathode of the diode is connected to a source that provides a power supply clamp voltage. The current drawn by the photocathode is increased until the cathode voltage reaches the power supply clamp voltage, whereupon the diode becomes forward biased. As a result, the cathode voltage is maintained at the power supply clamp voltage.

This circuit is difficult to implement in practice, however, since the tube clamp voltage is not always known. The tube clamp voltage is dependent upon the thickness and conductivity of the aluminum oxide film, which is dependent upon the manufacturing process. Thus, the thickness and conductivity varies with each tube. In a sample of GEN III tubes, the tube clamp voltage has a normal distribution curve with a mean of eighteen volts and a standard deviation of four volts. To avoid rejecting tubes during construction (i.e. to accommodate as many tubes as possible), the power supply clamp voltage is selected at 40 volts. If, however, the image intensifier tube has a tube clamp voltage of 10 volts, the photocathode will emit more electrons than the rest of the tube can handle. As a result, electrons pile up on the aluminum oxide film of the MCP and resolution at the phosphor screen is degraded. Thus, the problem of relying solely on the power supply clamp voltage—due to tube construction—is apparent.

The '077 patent describes apparatus to provide a bright source protection circuit that varies the photocathode voltage in response to current drawn by the photocathode. The circuitry and apparatus described in the '077 patent operates to modulate the voltage supplied to the tube's photocathode in response to the current drawn by the photocathode. In the '077 patent, the photocathode is pulsed ON and OFF according to the current drawn by the photocathode. An attempt is made to keep cathode current constant at some ideal level.

An image intensifier tube wherein it is possible to select a cathode voltage on-time to get optimum high light (1–50 ft cd) resolution and where low light resolution is not affected, is provided herein. This feature is achieved with a minimum number of components. The circuit shown herein has one more additional component than used in a standard power supply. This invention can be implemented in existing power supply cases.

The present invention pulses the photocathode ON and OFF at a given rate and for a given time to cause the image intensifier to operate at a relatively constant resolution over a wide range of input light intensity and only operates after cathode voltage drops to the clamp level where the light level is high enough to cause degradation. In operation, the resolution of the tube is relatively constant over the entire range of light intensity.

SUMMARY OF THE INVENTION

In an image intensifier tube having a photocathode which draws a current in response to the brightness of input light, the improvement therewith comprising pulsing means for pulsing said photocathode ON and OFF at a selectable rate to maintain a relatively constant resolution for said intensifier over the entire operating range of light input values.

FIGS. *2a*, *2b* and *2c* are a series of timing diagrams depicting the operation of the resolution control circuit according to this invention.

Figure 3:
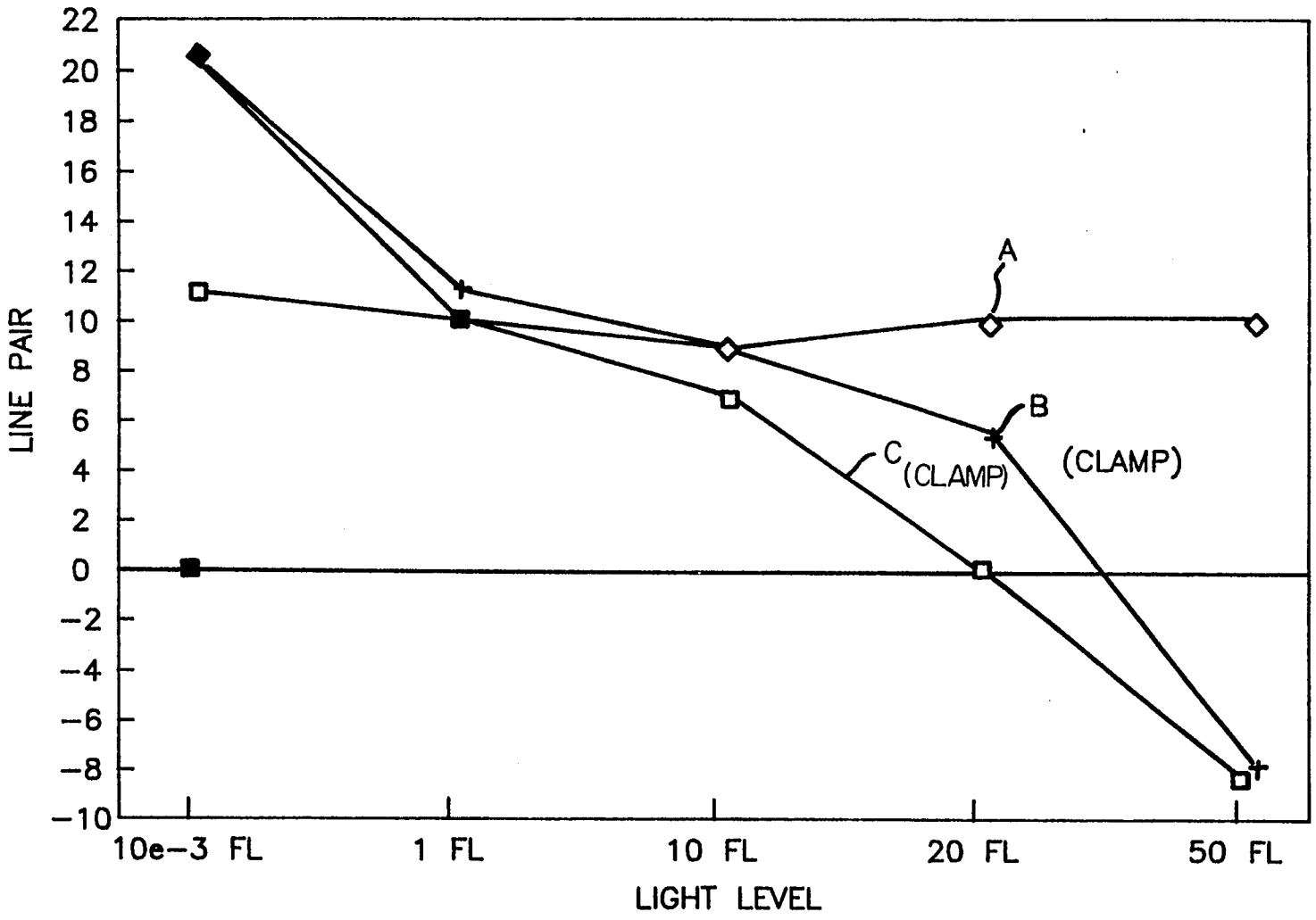

FIG. 3 is a graph depicting resolution and light level to compare the operation of the high light resolution controlled image intensifier tube according to this invention with conventional clamped tubes.

DETAILED DESCRIPTION OF THE FIGURES

Figure 1:
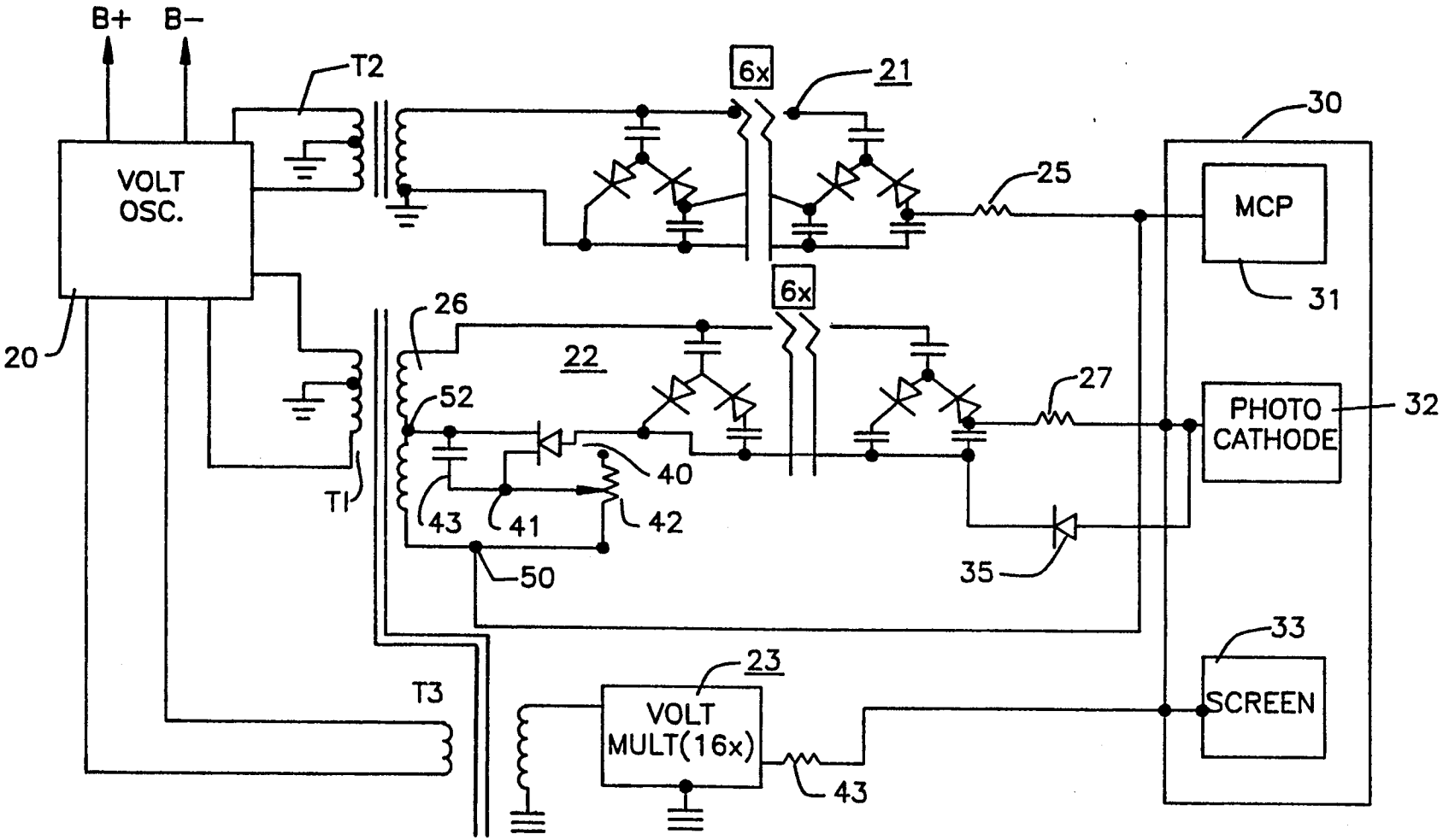
FIG. 1 is a schematic diagram of a power supply incorporating a high light resolution control circuit for an image intensifier and according to this invention.

Referring to FIG. 1, there is shown a typical power supply utilized for an image intensifier tube 30. For purposes of the present explanation it is assumed that the image intensifier tube 30 is a GEN III image intensifier tube. As is known, the image intensifier tube requires operating potentials which are provided to the photocathode 32, the microchannel plate or MCP 31 and the phosphor screen 33. These potentials are applied by first, second and third voltage multipliers as for example, multipliers 21, 22 and 23. Basically the multipliers operate by providing a high voltage output which is obtained from an alternating current (AC) of a given peak-to-peak value. The AC voltage is multiplied through a series of cascaded voltage doublers. For example, in regard to multipliers 21, 22, the doublers consist of capacitors and diodes which configurations are well known. As is well known, an output voltage may be increased with voltage doublers or multiplier circuits. In a conventional voltage doubler, capacitors are charged during alternate half cycles of the AC waveform to approximately the peak input value. The capacitors than discharge in series through the resistors. Such voltage doublers are designated as cascade voltage doublers and can operate to multiply voltage by given factors, such as 2 times, 8 times, 16 times and so on. The multipliers 21 and 22 are 6× multipliers while multiplier 23 is a 16× multiplier. For a typical GEN III image intensifier tube 30, the phosphor screen 33 is usually supplied with a voltage of about 6,000 volts or 6 kV. The photocathode 32 is usually supplied with a negative operating potential of approximately −1600 volts or (−1.6 kV). As shown in FIG. 1, the voltage multiplier 22 provides an operating potential to the photocathode 32 while the voltage multiplier 23 supplies an operating voltage to the screen 33 of about 6,000 volts. The multiplier 21 supplies a potential of −800 volts to the input plane of the MCP 31. The output plane of the MCP is grounded. For examples of suitable operating potentials reference is made to the above-noted U.S. Pat. No. 5,146,077. While the discussion as indicated is related to the GEN III image intensifier 30 it can be used for other image intensifiers. The power supply including the multiplier contains an oscillator 20 which operates at a given frequency. Essentially the oscillator 20 is biased by means of suitable DC potentials designated as B+ and B− which potentials causes the oscillator to provide an AC signal at a given frequency. The AC signal is coupled to the primary windings of suitable transformers designated in FIG. 1 as T1, T2 and T3. Each primary winding is associated with one or more respective secondary windings where the voltage from the primary winding may be stepped-up in magnitude or otherwise transferred by well-known techniques. Transformers, as well as turns ratios for primaries and secondaries including core construction and so on are well-known in the field. As seen in FIG. 1, transformer primary winding T2 applies an operating AC potential to the input of the voltage multiplier 21 which produces a high output DC voltage. This DC voltage is applied to the MCP 31 of the image intensifier 30 via resistor 25. The primary winding T1 supplies an AC operating potential to primary winding 26 associated with voltage multiplier 22. The output of multiplier 22 supplies a high voltage DC to the photocathode 32 via resistor 27. There is shown a diode 35 which has its anode electrode connected to the photocathode of the image intensifier tube with the cathode of diode 35 coupled to the anode electrode of a thyristor switch 40. The term thyristor switch is used synonymously with the term silicon controlled rectifier or SCR. The device is a four layer PNPN or NPNP device. The secondary winding 26 has a tap 52 which is coupled the cathode of the thyristor switch 40. The gate electrode 41 of the thyristor switch 40 is coupled to the variable arm of a potentiometer 42. The potentiometer 42 has one terminal coupled to terminal 50 of the secondary winding 26. The other terminal of the potentiometer 42 is uncoupled. Also coupled to the variable arm of the potentiometer 42 is one terminal of a capacitor 43 whose other terminal is coupled to the tap 52 of the secondary winding 26 of the transformer winding T1. The tap 52 is also coupled to the cathode electrode of the SCR 40.

As is known, the power supply shown in FIG. 1 provides high voltages at relatively low currents to the image intensifier. Such power supplies are well-known for supplying power to image intensifier tubes. Also shown indicated in FIG. 1 is a primary winding T3 coupled to voltage multiplier 23 which has an output resistor 43 coupled to the screen electrode 33 of the image intensifier tube 30. The photoresponse of a photocathode for a GEN III image intensifier tube is well-known. For an example of a photoresponse for a GEN III, reference is made to the above-noted patent U.S. Pat. No. 5,146,077. The photoresponse of a GEN III tube is typically non-linear. For a typical tube, the photoresponse is zero when the potential difference is less than 20 volts. Thus, the tube clamp voltage is about 20 volts. The photocathode voltage is approximately 800 volts at which voltage the photoresponse is approximately 1,000 microamps per lumen. In an unprotected GEN III image intensifier tube, the photocathode will draw approximately 100 nanoamps of current for a bright source of 10 foot-candles. This is a typical tube operation. There are tubes which are commercially available, which operate with a 20 volt clamp voltage, a 30 volt clamp voltage, and a 40 volt clamp voltage. The bright source protection circuit of the prior art, operated to pulse width, modulate the photocathode voltage over the higher order magnitudes ($10^{-2}$ to $10^{1}$ foot-candles) and employed the dropping resistor 27 to reduce the photocathode voltage over the lower order magnitudes ($10^{-6}$ to $10^{-2}$ foot-candles). The dropping resistor 27 typically has a value of fifteen Gigaohms and is connected between the output of multiplier 22 and the input terminal of the photocathode 32. A ten nanoamp increase in current drawn by the photocathode 32 results in a fifteen volt drop across the resistor 27. The decreased voltage at the input terminal of the photocathode 32 reduces the photoresponse and thereby reduces the current drawn by the photocathode. In the '077 patent when the current drawn by the photocathode exceeds a predetermined threshold, the circuit modulated the photocathode voltage by pulsing the voltage ON and OFF at a rate determined by the amount of current and hence by pulse width modulation. In this invention, the photocathode is pulsed ON and OFF only in clamp and high light magnitude range as from 10 to 50+ foot-candles. As is well known, clamp voltage occurs during high light input when diode 35 begins to conduct, thus placing the tube in clamp. As seen in FIG. 1, a reference potential from multiplier 21 is supplied via resistor 25 to the bottom terminal 50 of the secondary transformer winding 26. The reference potential is applied to the terminal of potentiometer 42. The gate electrode of the SCR 40 is coupled to the variable arm of the potentiometer 42, which arm is set so that the SCR or thyristor 40 will alternately conduct or will be operated in the ON position for a given time period. When the SCR conducts, there is no photocathode current. For example, by adjusting potentiometer 42, the photocathode current can be reduced from one-half the typical value. With the potentiometer 42 adjusted, the photocathode current can be adjusted from zero to full conduction. Due to the operation of the SCR 40, there is both an amplitude and conduction phase angle shift. By adjusting the duration of time the SCR is conducting or is ON, one can adjust the amount of time the photocathode is conducting or ON. In this manner, one can achieve high light resolution control by controlling the on-time of the photocathode. The capacitor 43 as connected between the cathode and the gate of the SCR 40 provides a time constant (RC) with the resistive value of the potentiometer 42. The SCR 40 has its anode electrode coupled directly to the cathode of the diode 35 of the high voltage multiplier 22. The cathode electrode of the SCR is coupled to the tap 52 on the transformer. As indicated, the capacitor and the setting of the variable potentiometer form a RC circuit. As is understood, the SCR or thyristor 42 is a four layer (pn-pn) semiconductor device which can be switched from an OFF state to an ON state. The SCR 40 will continue to conduct as long as the external load current is greater than the holding current of the device. Such devices which exhibit such operation include silicon controlled rectifiers (SCR), triacs, diacs, silicon control switches, reverse blocking diodes, thyristor switches and programmable uni-junction transistors. As indicated above, the device 40 is referred to generically as a SCR or thyristor. The equivalent circuit for an SCR is a NPN transistor connected to a PNP transistor. Thus, as is well known with the gate electrode open, or shorted to the cathode the device is off and no current flows from anode to cathode except for negligible leakage current. When an external positive pulse is applied to the gate electrode (which essentially is analogous to the base electrode of an NPN transistor), the NPN transistor is turned ON and the resulting collector current becomes the base current from the equivalent PNP transistor. Then the collector current of the PNP transistor supplies base current to the NPN transistor. This is a regenerative action which maintains the SCR in the conducting state and thus the gate signal may be removed. The device continues to conduct until the anode voltage is less positive than the cathode voltage.

Figure 2A:
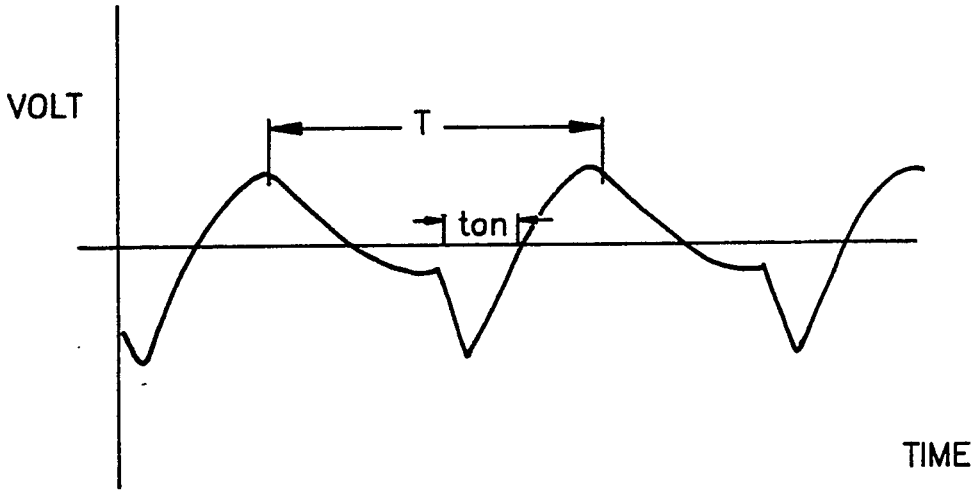
Figure 2B:
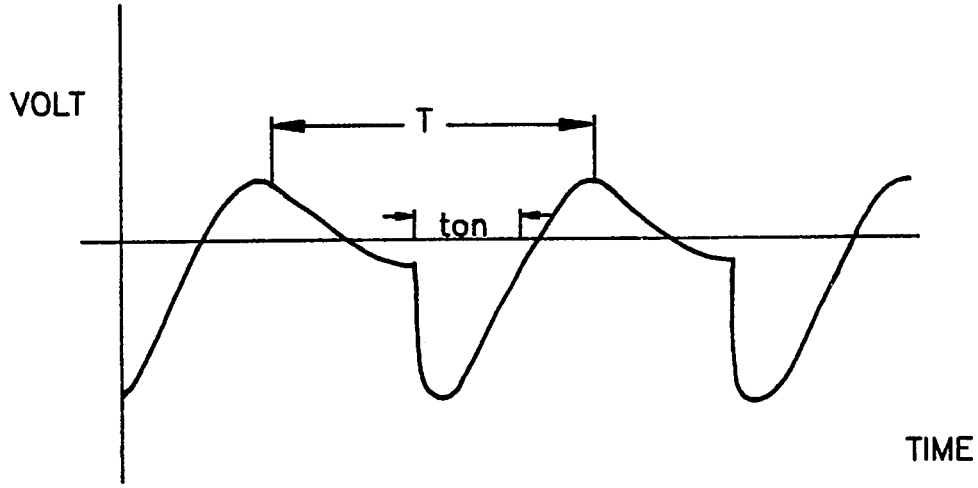
Figure 2C:
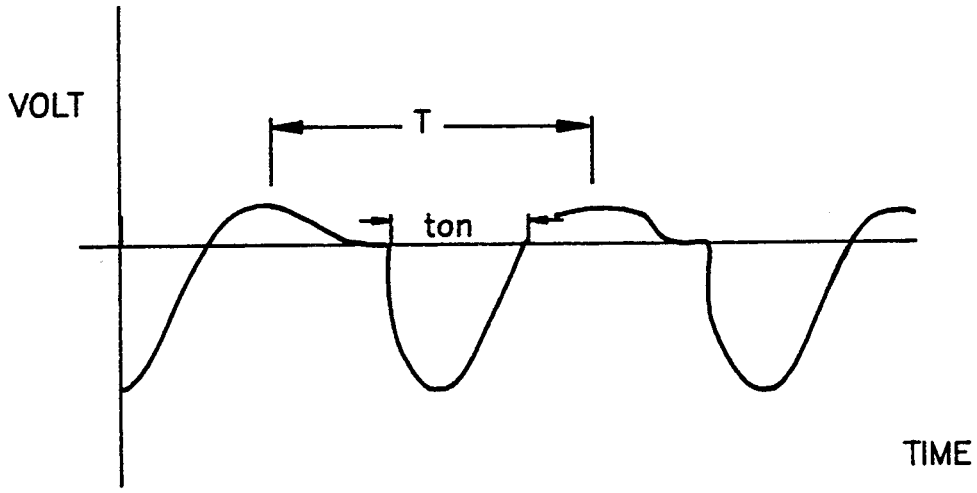

As indicated, the cathode of the SCR 40 is coupled to the tap 52 of the transformer secondary winding 26. The winding 26 receives an AC signal of a given peak-to-peak value from the primary winding T1. The gate electrode is controlled by the setting of potentiometer 42 which provides a DC bias to the gate electrode. Thus, the SCR 40 can be triggered ON by either a positive or negative pulse or transition (depending upon the device) or a positive or negative edge which is applied to the gate electrode via the transformer and which pulse is directed through capacitor 43. The control of SCR 40 is essentially a capacitor discharge effect which can trigger the SCR 40 into conduction. The current flow through the SCR 40 diverts the current away from the photocathode 32. The SCR 40 is caused to conduct or turned ON by triggering of the gate electrode, it then ceases conduction as the capacitor discharges through the resistor potentiometer. Thus a given polarity pulse is coupled to gate electrode causing current to flow through capacitor 43 and the potentiometer 42, thus turning the SCR 40 ON. The SCR is held ON until capacitor 43 discharges as a function of the setting of potentiometer 42. Since the current from the high voltage multiplier 22 is low, the SCR 40 turns off and the charging cycle begins again whereby the SCR continues to be triggered in the ON condition during suitable transitions of the input AC signal as applied to the gate electrode. When the SCR 40 conducts, there is little or no current supplied to the photocathode 32 and hence when the SCR 40 is conducting or is in the ON state, the photocathode 32 is OFF and vice versa. This cycle continues at a given repetitive rate as shown in FIGS. 2*a*, 2*b* and 2*c*. The repetitive rate is the rate of the AC signal from oscillator 20. The time of conduction ($t_{on}$) of the SCR 40 is strictly a function of the setting of resistor 42 which, as indicated, operates to form an RC time constant with capacitor 43.

Referring to FIG. 2*a*, 2*b* and 2*c*, there is shown three diagrams indicating the voltage waveform across the secondary winding 26 of the transformer T1 due to the conduction of the SCR 40. FIG. 2*a* shows the typical voltage waveform across the secondary winding 26 where the SCR is conducting for a period designated in the diagram as $t_{on}$. A cycle or the repetition rate of operation is indicated by T and is approximately equal to 40 microseconds or at a frequency of 25 KHz. Thus each time interval in the figure (box) is approximately equal to 10 microseconds. As can be seen from FIG. 2*a*, the potentiometer 42 is adjusted so that the SCR 40 is conducting for a period or on-time of 8 microseconds divided by 40 or approximately 20 percent of the time. This implies that the photocathode is operating in an ON mode for 80 percent of the time. In FIG. 2*b*, the SCR 40 is conducting for a period of about 12 microseconds as divided by 40 or about 30 percent of the time, thus operating the photocathode at 70 percent of the time. In FIG. 2*c*, the SCR is conducting for about 16 microseconds out of the 40 microsecond period or about 40 percent of the time. By pulsing the photocathode ON and OFF for high light conditions (i.e., from 1 to 50+ foot-candles), the output resolution of the image intensifier is held up for this range of light intensity. The on-time of the SCR 40 is controlled by adjusting the variable arm of the potentiometer 42 as described. In a typical embodiment using a GEN III image intensifier 30, resistor 27 had a value of approximately 15 Gigaohms, resistor 25 a value of 1,000 ohms with resistor 43 having a value of 22 megohms. The potentiometer 42 had a value of between 200 to 250K ohms, with capacitor 43 having a value of 100 picofarads. The SCR 40 was a GA301 available from Unitrode Corporation, sold as a commercial nanosecond switching planar thyristor switch or SCR. The particular SCR or thyristor switch combines a turn on speed of logic level transistors with a high current switching capability. Such devices provides extremely fast rise and delay times and operate under relatively high current conditions. As indicated, with no adjustment, the photocathode current of the intensifier is basically reduced to 50 percent of the value as would normally exist without the SCR 40. By adjusting the potentiometer 42, the cathode current is adjustable to zero. In any event, one can cause the SCR 40 to continuously operate to pulse the photocathode 32 and thereby maintain high resolution operation over a relatively wide range of light inputs.

Referring to FIG. 3, there is shown a graph depicting resolution on the vertical axis against the light level on the horizontal axis. The graph depicted in FIG. 3 depicts resolution in lines pairs (Y axis) versus light input intensity in foot-candles or foot-lumens (FL). A line pair consists of a pair of parallel lines to which the image intensifier can respond to within a given resolution. As one can see from FIG. 3 there is shown three devices namely A, B and C. Device A is the device shown in FIG. 1 with the SCR circuit connected to the photocathode 32 as described. Device B is a typical prior art image intensifier with a 30 volt clamping level, while device C is a typical prior art image intensifier with a 40 volt clamping level. As one can ascertain, both devices B and C essentially follow the same curve and their resolution is good for low light intensities and decreases substantially at high light intensities where the resolution eventually is negative and extremely poor. Both devices B and C follow the same general curves. As one can ascertain, the device A which is depicted in FIG. 1 and has a chopped photocathode waveform exhibits a relatively constant resolution starting from a resolution of about 12 at very low light levels and ending with about the same resolutions at 50 FL.

The pulse width from the SCR circuit is adjusted at 20 foot candles to obtain the proper resolution. For low light levels, as from $10^{-6}$ to $10^{-2}$ foot candles, every election counts and therefore pulsing does not occur at low levels and only commences, as in U.S. Pat. No. 5,146,077, when the clamp diode 35 is operated to conduct. However, one achieves an increased resolution due to the higher clamp voltage as obtained with controlling the ON time of the SCR due to the RC time constant as varied by the potentiometer.

It will be understood that the embodiments described are merely examples and that a person skilled in the art can make many variations and modifications without departing from the spirit and scope of the invention. It is of course understood that different values can be employed for the components, as described. All such modifications are intended to be included with the scope of the invention as defined in the appended claims.

What is claimed is:

1. In an image intensifier tube having a photocathode which draws a current in response to the input values of light over an operating range, the improvement therewith comprising;

pulsing means for pulsing said photocathode ON and OFF at a predetermined rate;

variable control means for selectively varying said predetermined rate, thereby enabling said predetermined rate to be selectively varied to supply a relatively constant resolution for said intensifier over said operating range of light input values.

2. The image intensifier tube according to claim 1, wherein said operating range of light values is from $10^{-6}$ to $10^{1}$ foot-candles.

3. The image intensifier tube according to claim 1, being a GEN III tube having a microchannel plate (MCP), a phosphor screen and said photocathode.

4. The image intensifier tube according to claim 1, wherein said predetermined rate corresponds to the photocathode being pulsed ON between 60–80 percent of the operating time and therefore pulsed OFF between 20–40 percent of the operating time.

5. The image intensifier tube according to claim 2, further including voltage means coupled to an input terminal of said photocathode for providing said photocathode with a voltage, wherein said pulsing means is coupled to said input terminal of said photocathode to pulse said photocathode ON and OFF at said predetermined rate.

6. The image intensifier tube according to claim 5, wherein said pulsing means includes a controlled rectifier having an anode electrode coupled to said input terminal, a cathode electrode coupled to a point of reference potential and a gate control electrode coupled to a bias source, whereby the magnitude of the bias source determines the ON and OFF time of said photocathode.

7. The image intensifier tube according to claim 6, wherein said controlled rectifier is a silicon controlled rectifier (SCR).

8. The image intensifier tube according to claim 6, wherein said variable control means includes a variable resistor having one terminal connected to a point of reference potential and having a variable arm connected to said gate control electrode of said controlled rectifier for applying a bias to said gate electrode according to the setting of said variable arm.

9. The image intensifier tube according to claim 8 further including a capacitor having one terminal coupled to said variable arm and one terminal coupled to said cathode electrode, wherein said capacitor and said variable resistor value determine the conducting ON time of said controlled rectifier and therefore of said photocathode.

10. The image intensifier tube according to claim 9, wherein said photocathode current is variable between zero to a given value by adjustment of said variable resistor.

11. In an image intensifier tube having a photocathode with an input terminal, and a first voltage multiplier which provides an operating potential to said input terminal of said photocathode, wherein said photocathode draws a current in response to the brightness of input light, the improvement therewith comprising:

a resistor coupled between an output of said first voltage multiplier and said input terminal of said photocathode;

a controlled rectifier having anode, cathode and gate control electrodes, with said anode electrode coupled to said output of said voltage multiplier with said cathode electrode coupled to a point of reference potential;

variable bias means coupled to said gate electrode for selectively controlling the conduction time of said controlled rectifier to cause said photocathode current to pulse ON and OFF in accordance with said conduction time of said controlled rectifier, whereby the resolution of said image intensifier tube remains relatively constant over a wide range of light input values and independent of the brightness of input light.

12. The image intensifier tube according to claim 11, wherein said controlled rectifier is a silicon controlled rectifier (SCR).

13. The image intensifier tube according to claim 11, wherein said photocathode has an operational range of between $10^{-6}$ to $10^{1}$ foot-candles.

14. The image intensifier tube according to claim 13 wherein said variable means includes a potentiometer having a terminal coupled to a point of reference potential, and having the variable arm coupled to said gate control electrode of said SCR, and a capacitor having a one terminal coupled to said variable arm of said potentiometer and said other terminal coupled to said cathode of said SCR whereby said potentiometer and said capacitor form an RC network for triggering said SCR.

15. The image intensifier tube according to claim 11, further including a MCP having an input plane, a second voltage multiplier for providing operating potential to said input plane of said MCP, a resistor coupled between the output of said second voltage multiplier and the input terminal of said input plane, means coupling said input terminal of said MCP to said reference potential terminal of said potentiometer.

16. The image intensifier tube according to claim 11, wherein said tube is a GEN III intensifier.

17. The image intensifier tube according to claim 12, wherein said photocathode is pulsed ON between 60–80 percent of the operating rate.

18. The image intensifier tube according to claim 15, wherein said operating rate is at a frequency of 25 KHz.

19. The image intensifier tube according to claim 16, wherein said potentiometer is variable between 0 to 250,000 ohms and said capacitor is 100 picofarads.

20. The image intensifier tube according to claim 11, wherein said controlled rectifier is a planar thyristor switch.

* * * * *